US009708919B2

(12) United States Patent
Dungs et al.

(10) Patent No.: US 9,708,919 B2
(45) Date of Patent: Jul. 18, 2017

(54) BLADE ARRANGEMENT

(75) Inventors: Sascha Dungs, Wesel (DE); Elliot Griffin, Winter Springs, FL (US); Markus Paus, Oberhausen (DE); Stefan Reichling, Bochum (DE); Uwe Sieber, Mulheim an der Ruhr (DE); Hubertus Michael Wigger, Cologne (DE); Dirk Wistuba, Mulheim an der Ruhr (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 648 days.

(21) Appl. No.: 14/239,138

(22) PCT Filed: Aug. 14, 2012

(86) PCT No.: PCT/EP2012/065840
§ 371 (c)(1),
(2), (4) Date: Feb. 16, 2014

(87) PCT Pub. No.: WO2013/026735
PCT Pub. Date: Feb. 28, 2013

(65) Prior Publication Data

US 2014/0234111 A1 Aug. 21, 2014

(30) Foreign Application Priority Data

Aug. 24, 2011 (EP) ..... 11178635

(51) Int. Cl.
*F01D 5/32* (2006.01)
*F01D 5/30* (2006.01)
*F04D 29/32* (2006.01)

(52) U.S. Cl.
CPC ..... *F01D 5/323* (2013.01); *F01D 5/3038* (2013.01); *F01D 5/32* (2013.01); *F01D 5/326* (2013.01); *F04D 29/322* (2013.01)

(58) Field of Classification Search
CPC ..... F01D 5/323; F01D 5/3038; F01D 5/32; F01D 5/326; F04D 29/322
See application file for complete search history.

(56) References Cited

U.S. PATENT DOCUMENTS 5,018,941 A 5/1991 Heurtel
8,512,001 B2 8/2013 Benkler et al.
(Continued)

FOREIGN PATENT DOCUMENTS

DE 652188 C 10/1937
DE 1085643 B 7/1960
(Continued)

OTHER PUBLICATIONS

RU Grant Decision dated Aug. 14, 2016, for RU application No. 2014111052.

*Primary Examiner* — Ryan J Walters
(74) *Attorney, Agent, or Firm* — Beusse Wolter Sanks & Maire

(57) ABSTRACT

A blade arrangement is provided having a blade carrier and a retaining groove arranged therein, which retaining groove has projections extending along side walls thereof forming undercuts and into which a number of blades are inserted forming a blade ring of a turbomachine. Each blade has a blade root which engages into the undercuts, and each blade is pressed against the projections by an element arranged between a blade root underside and a groove base of the retaining groove. It is further provided that each element is of plate-like form and has, in the projection of the blade airfoil in the direction of the groove base, at least one bead, arranged beneath the blade airfoil, for imparting a pressing
(Continued)

action, and in the longitudinal direction of the retaining groove, only part of the blade root which the element presses against is covered.

19 Claims, 6 Drawing Sheets

(56) References Cited

U.S. PATENT DOCUMENTS

| | | | |
|---|---|---|---|
| 8,529,209 | B2 | 9/2013 | Belmonte et al. |
| 2001/0019697 | A1 | 9/2001 | Mueller |
| 2004/0086387 | A1 | 5/2004 | Fitts et al. |
| 2009/0004017 | A1 | 1/2009 | Belmonte |

FOREIGN PATENT DOCUMENTS

| | | | |
|---|---|---|---|
| EP | 0378474 | A1 | 7/1990 |
| EP | 1130217 | A1 | 9/2001 |
| EP | 2009245 | A1 | 12/2008 |
| JP | S61103599 | U | 7/1986 |
| JP | 2009008079 | A | 1/2009 |
| JP | 2011511896 | A | 4/2011 |
| RU | 2136973 | C1 | 9/1999 |
| RU | 2331774 | C2 | 8/2008 |
| SU | 55545 | A1 | 8/1939 |
| WO | 2005010323 | A1 | 2/2005 |

BLADE ARRANGEMENT

CROSS REFERENCE TO RELATED APPLICATIONS

This application is the U.S. National Stage of International Application No. PCT/EP2012/065840 filed Aug. 14, 2012, and claims the benefit thereof. The International Application claims the benefit of European Application No. EP11178635 filed Aug. 24, 2011. All of the applications are incorporated by reference herein in their entirety.

FIELD OF INVENTION

The invention relates to a blade arrangement.

BACKGROUND OF INVENTION

Blade arrangements are known very well from the comprehensive available prior art. The known blade arrangements are used both for guide blade rows and for moving blade rows of compressors, a circumferential groove for receiving all the blades of the row being provided in a blade carrier. The blades are fastened in the circumferential groove with the aid of a hammer-shaped or dovetail-like form fit, in that correspondingly designed blade roots engage behind projections protruding from the side walls of the holding groove. In order to bring about play-free, low-wear and reliable bracing of the blades in the holding groove, it is known to insert between the blade root underside and the groove bottom substructures configured as feather keys, spring elements in the form of a helical spring or a longitudinally and transversely slotted clamping sleeve. Mounting and manufacturing plays present in the radial direction between blade and groove can consequently be compensated, thus making simple production and mounting possible. The problem is that the plays in the radial direction may cause difficulties in ensuring the tolerances in the circumferential direction of the groove. It is therefore known that, in order to set the radial gaps between the airfoil tip and a duct boundary lying directly opposite the latter, the profile ends are ground over or brought to size by turning a lathe, while the blades mounted in the groove are being pressed outward. Apart from this, there is often the problem of achieving simple mountability and demountability of blades and the substructures, along with low production costs.

SUMMARY OF INVENTION

An object herein, therefore, is to provide a blade arrangement in which a long-lived and at the same time reliable and also secure fastening of the blades in the circumferential groove, along with simple mounting and demounting, is ensured.

This object is achieved by means of a blade arrangement according to the features of the independent claim. Advantageous refinements of the invention are specified in the dependent claims which may be combined with one another in any desired way.

According to aspects of the invention, there is provision whereby each element is of plate-shaped design, has, in the projection of the airfoil in the direction of the groove bottom, at least one bead, arranged below the airfoil, for pressing the blade down in the groove and is covered in the longitudinal direction of the holding groove only partially by the blade root pressed down by said element.

With the aid of the element according to aspects of the invention, it is possible for the latter to have an especially suitable shape which makes a locally resilient substructure possible and, at another local point, a rigidly acting substructure possible. Moreover, the element can, on the one hand, be produced especially simply and, on the other hand, at the same time be mounted and demounted especially simply. The stiffening action is generated by a bead or a plurality of beads. Simple mountability and demountability are achieved in that the respective element is covered in the longitudinal direction of the holding groove only partially by the blade root pressed down by said element. Thus, a portion of the element always protrudes and can be reached especially simply for a demounting tool. Furthermore, the plate-shaped geometry of the element makes it possible to have a space-saving design and blade arrangement.

The refinement is especially preferred in which a one-part or multipart intermediate piece is inserted in the holding groove in each case between two blades and is pressed against the projections by that part of the element which is not covered by the blade root. In this case, there is an identical number of blades, intermediate pieces and elements, the elements having a longitudinal extent which is identical to the longitudinal extent of the blade root and intermediate piece. The elements are mounted, offset with respect to intermediate pieces and blades, so that, as seen in the longitudinal direction of the holding groove, the element extends through completely under the blade root and in each case partially as far as under the two intermediate pieces adjacent to the blade root. Each intermediate piece is consequently pressed against the projections of the holding groove by two elements.

Preferably, the elements are designed in such a way that the respective intermediate pieces are pressed against the projections with lower force than the blade root pressed against the projections by the respective element. In particular, different rigidities of the element can consequently be utilized especially advantageously for different requirements. To be precise, for mounting the intermediate pieces, a lower spring force of the element is desirable and is not even required, since, during operation, there are also no high forces acting on the intermediate piece. By contrast, the blades firmly clamped in the blade carrier are exposed during operation to flow forces. This necessitates a more reliable fastening of the blades to the blade carrier, thus requiring a higher pressure force. The higher pressure force is achieved by means of the locally higher rigidity of the element. This is brought about by the bead or beads arranged in the element.

In the case of a more rigid underpinning of the blade, operating principles acting differently can advantageously be used for mounting and for subsequent operation. On the one hand, the local material plasticization of the bead is provided for the compensation of manufacturing tolerances during mounting. On the other hand, there is provision for utilizing the residual elasticity in order then to absorb the operating forces. For this purpose, a material for the element is advantageously used which is distinguished by a relatively high ratio of the characteristic numbers for maximum tensile strength (Rmax) to yield strength (RP0.2) (characteristic number Rmax/Rp0.2>1.5), although, in the choice of material, the yield strength must at the same time also be sufficiently high for the operating force.

The locally stiffer region of the element is preferably designed as a bead. The bead is especially advantageously configured in such a way as to afford a kinked characteristic curve in the force/path relation. A residual elasticity for absorbing the operating forces is thereby ensured over a wide range. This can be achieved by means of a first bead geometry in which the element has a wall thickness S and the bead has in cross section a bead width b and also two convex portions with a radius R2 and a concave portion arranged between them, with a radius R1, with a chord length A, to which the following applies:

R1>1.5S,

3*R2>R1<0.7R2 and 10b to 1.7b>a.

A second bead geometry with similar properties is achieved if R1>5S, 3*R2>R1 and a<0.9b.

A third bead geometry as a combination of the first two bead geometries with similar properties leads to a twofold bead, designated as a double bead, which has a further-increased elastic range.

The beads are preferably established in the element in such a way that they are arranged below the airfoil in the projection of the airfoil in the direction of the groove bottom. In other words, since the elements are established along the circumferential groove always so as to be offset with respect to the blades, the beads are basically arranged in the inner region of the element or at its margin. This enables the elements to be mounted and demounted in a simple way.

Preferably, further, the element has, in its region not covered by the blade root, at least one orifice. A demounting hook or tool can engage into this orifice in order to demount said element from its operating position.

Simple mountability of the element can be achieved if a groove extending along the holding groove is established as a demounting groove in the groove bottom of the holding groove or in the blade root underside. During demounting, a sliding hammer can be applied there comparatively simply, and during mounting the knocking/pressing in of the element between blade and groove by means of a ram is simplified.

Expediently, the element has, in the projection of the airfoil in the direction of the groove bottom (radial axis of vision), an outer contour which is essentially rectangular. In this projection, only half the respective element is covered by the blade pressed down by it. Elements contoured in this way can be produced especially cost-effectively and simply.

The refinement is especially advantageous in which at least one longitudinal edge of the element is angled and bears, prestressed, against the blade roots shaped correspondingly to it. Insofar as intermediate pieces are used in the blade arrangement, the angled longitudinal edges may also bear, prestressed, against the intermediate pieces shaped correspondingly to it. This refinement makes it possible that the blades are not oriented solely on the basis of the groove geometry and the blade root geometry, but are also oriented by means of the respective adjacent component, be it blade or intermediate piece. This feature serves for the advantageous reduction of contact wear.

Advantageously, further, the element has at least one margin at least one further bead for local stiffening and for guiding the element in a guide groove. This further bead at the margin, preferably the transverse edge, can simplify mounting, since a ram for knocking/pushing in the element between the blade root underside and the groove bottom can be applied at the local stiffening point, without the element being bent out of shape locally when subsequently being driven in.

The embodiment is especially preferred in which the bead is configured as an inner bead which is established in an outer bead at least partially surrounding the latter. This embodiment, also designated as a double bead, makes it possible to have a further increase in the elastic range of the element. It is likewise conceivable to use threefold beads or even n-fold beads, in which a corresponding number of beads are arranged, virtually stacked from inside outward or hierarchically.

The refinement is especially preferred in which the blade arrangement is used in an axial-throughflow compressor of a gas turbine, either for a moving blade ring and/or for a guide blade ring. This ensures reliable, safe and especially efficient operation of the gas turbine, since, with this refinement, the radial gaps between the airfoil tips and the opposite duct wall of the flow duct of the compressor can be designed to be especially small

BRIEF DESCRIPTION OF THE DRAWINGS

The invention is explained in more detail in the following figure description by means of several exemplary embodiments which do not restrict the invention. Further features and further advantages are in this case indicated. In these figures.

DETAILED DESCRIPTION OF INVENTION

Identical features are given the same reference symbols in the figures.

Figure 1:
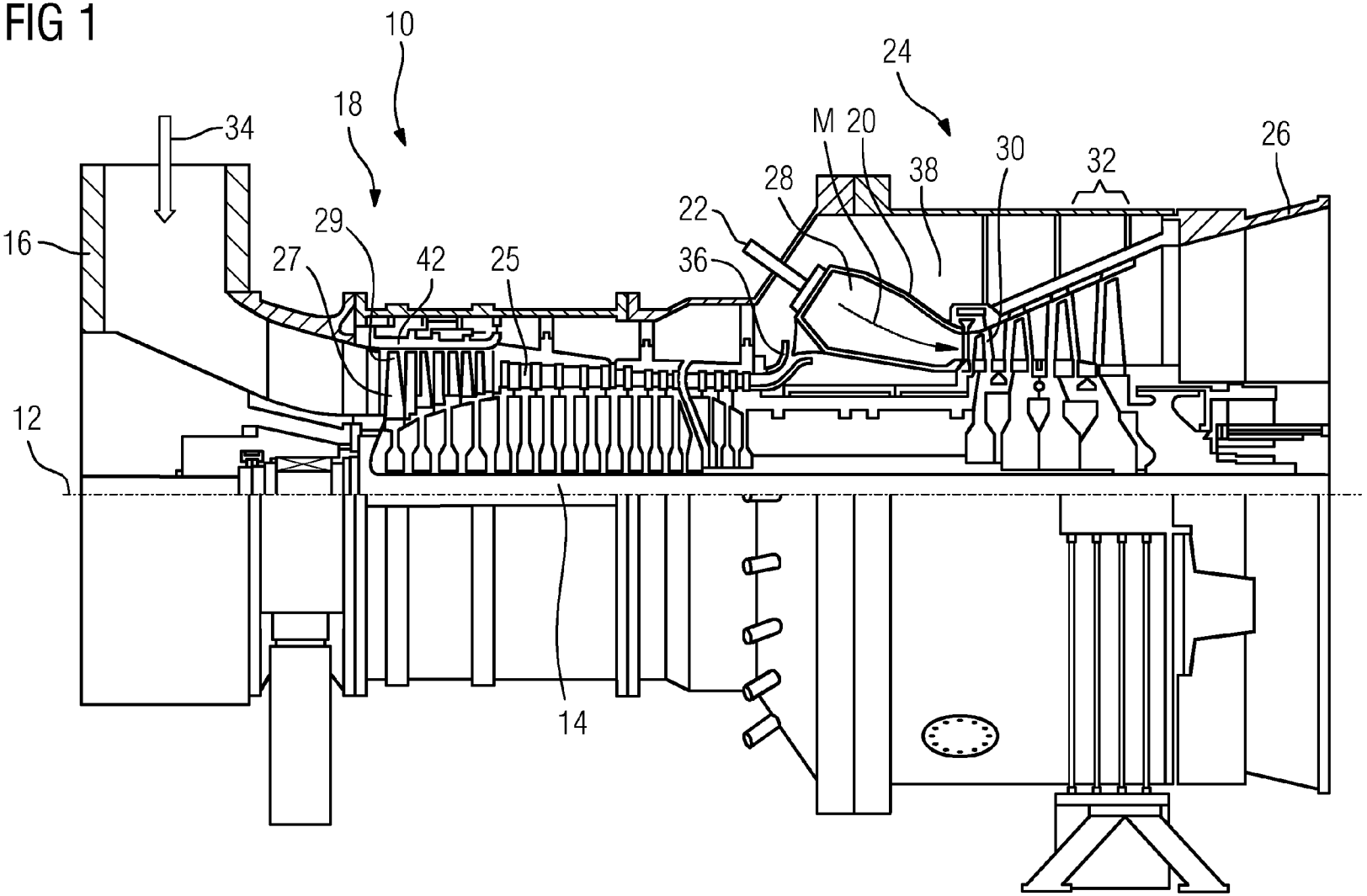
FIG. 1 shows a partial longitudinal section through a gas turbine.

FIG. 1 shows a stationary gas turbine 10 in a partial longitudinal section. The gas turbine 10 has inside it a rotor 14 which is rotationally mounted about an axis of rotation 12 and which is also designated as a turbine rotor. An intake casing 16, an axial turbocompressor 18, a toroidal annular combustion chamber 20 with a plurality of burners 22 arranged rotationally symmetrically to one another, a turbine unit 24 and an exhaust gas casing 26 succeed one another along the rotor 14.

The axial turbocompressor 18 comprises an annularly designed compressor duct with compressor stages succeeding one another in cascade in the latter and composed of moving blade and guide blade rings. The moving blades 27 arranged on the rotor 14 lie with their freely ending airfoil tips 29 opposite an outer duct wall 42 of the compressor duct. Guide blades 25 likewise project therein and are secured to the outer duct wall 42 or to a compressor guide blade carrier. The compressor duct issues via a compressor outlet diffuser 36 in a plenum 38. Provided in the latter is the angular combustion chamber 20 with its combustion space 28 which communicates with an annular hot gas duct 30 of the turbine unit 24. Four turbine stages 32 connected in series are arranged in the turbine unit 24. A generator or a working machine (not illustrated in either case) is coupled to the rotor 14.

When the gas turbine 10 is in operation, the axial turbocompressor 18 sucks in through the intake casing 16 ambient air 34 as the medium to be compressed and compresses this ambient air. The compressed air is routed through the compressor outlet diffuser 36 into the plenum 38, from where it flows into the burners 22. Fuel also passes via the burners 22 into the combustion space 28. The fuel is burnt there, with the addition of the compressed air, to form a hot gas M. The hot gas M subsequently flows into the hot gas duct 30 where it expands, so as to perform work, at the turbine blades of the turbine unit 24. The energy meanwhile released is absorbed by the rotor 14 and is utilized, on the one hand, for driving the axial turbocompressor 18 and, on the other hand, for driving a working machine or electric generator.

Figure 2:
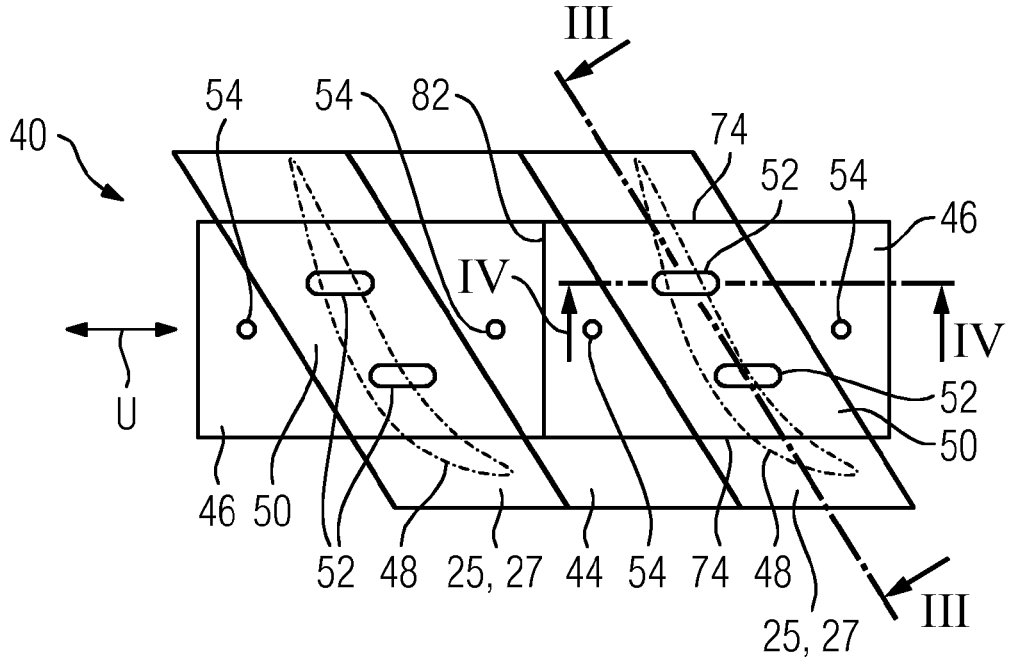
FIG. 2 shows a top view of a detail of a blade arrangement according to a first refinement.

FIG. 2 shows a top view of a detail of a blade arrangement 40 in which only two blades 25, 27 with an intermediate piece 44 established between them and two elements 46 arranged beneath them are illustrated diagrammatically. The blades 25, 27 comprise a diagrammatically indicated airfoil 48 and also a blade root 50. The top view is in the radial direction of the gas turbine 10, that is to say from the airfoil in the direction of the blade root 50. The blade carrier and a holding groove arranged in the carrier are not illustrated in FIG. 2. The elements 46 have a rectangular outer contour and are of plate-shaped design. They are also designated colloquially as sheet-like. In the first exemplary embodiment (FIG. 2), the blade roots 50 and the blades 25, 27 of the blade arrangement are arranged obliquely with respect to a longitudinal extent of the holding groove or of a circumferential direction U. This positioning is typical of moving blades.

Each element 46 has two beads 52 and in each case two orifices 54. The elements 46 are as long in the circumferential direction U as the blade root 50 and intermediate piece 44 are together. However, the elements 46 are arranged centrally below the respective blade 25, 27, so that two adjacent elements 46 terminate centrally in each case with their opposite ends below the intermediate pieces 44.

Figure 3:
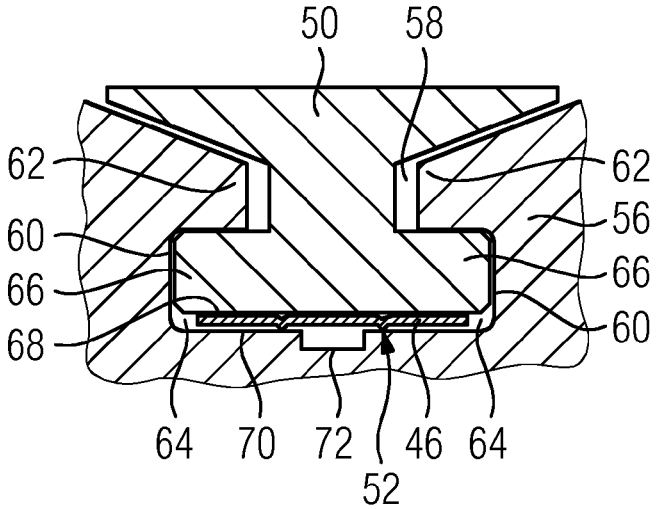
FIG. 3 shows a cross section through the blade arrangement according to FIG. 2 along the sectional line III-III.

FIG. 3 shows the cross section along the sectional line III-III through the blade root 50 of the blade 25, 27 and a blade carrier 56. The airfoil is not illustrated in FIG. 3 (nor in FIGS. 5, 6, 8, 9, 11 and 12). A holding groove 58, in which the blades 25, 27, in particular the blade roots 50 of the blades 25, 27, are inserted with a form fit, extends in the blade carrier 56. To make the form fits, the side walls 60 of the holding grooves 58 have longitudinally extending projections 62 so as to form undercuts 64. Correspondingly formed hammer-shaped root regions 66 engage into the undercut 64.

The element 46 is braced between a blade root underside 68 and a groove bottom 70 of the holding groove 58. Moreover, a further demounting groove 72 extending along the holding groove 58 is provided in the groove bottom 70. The further groove 72 serves for access for a demounting tool, for example a sliding hammer.

The wall thickness S of the element 46 (FIG. 14) is smaller than the gap dimension between the blade root underside 68 and groove bottom 70. The beads 52 produced in the element 46 by deep-drawing or by pressing in increase the height H of the element 46 beyond the gap dimension, so that the blade root 50 is pressed against the projections 62. This results in an unequivocal defined position of the blades 25, 27 in the holding groove 58.

Figure 4:
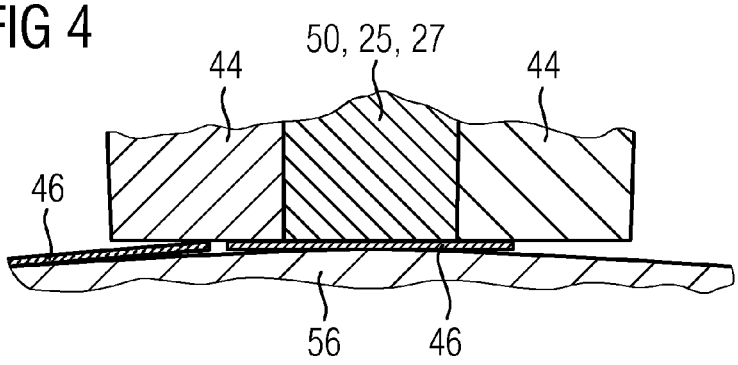
FIG. 4 shows the longitudinal section through the detail of the blade arrangement according to FIG. 2 along the sectional line IV-IV.

FIG. 4 shows the longitudinal section through the refinement according to FIG. 2 along the sectional line IV-IV. The embodiment, illustrated in FIGS. 2, 3 and 4, of the blade arrangement 40 is a detail of a moving blade ring of a compressor 12 of the gas turbine 10. The blade carrier 56 is accordingly formed by a rotor disk and the blades 25, 27 are designed as moving blades.

The elements 46 are essentially planar and therefore do not follow the curvature of the holding groove 58. On account of this, the elements 46, with their middle region in which the beads 52 are arranged, press the blade root underside 68 and groove bottom 70 apart from one another with greater force. Those portions of the element 46 which are adjacent to the transverse edges 82, because of the planar configuration of the elements 46 and the curved holding groove 58, then bear with lower force resiliently against the undersides of the intermediate pieces 44. Consequently, the element 46 presses the intermediate pieces 44 and the blades 25, 27 against the projections 62 of the holding groove 58 with forces of different magnitude on account of locally different rigidities.

Figure 5:
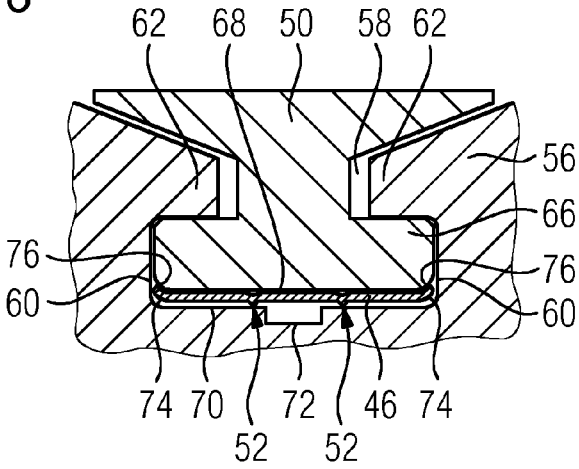
FIG. 5, FIG. 6 show the cross sections through a blade arrangement, similar to the sectional line IV-IV, for a second and a third refinement.

A second refinement of a blade arrangement 40 is illustrated in FIG. 5. FIG. 5 shows essentially the cross section according to FIG. 3. In this case, features identical in FIG. 5 to FIG. 3 are given identical reference symbols. To describe FIG. 5, reference is made as far as possible to the description of FIG. 3. According to the second refinement, however, the longitudinal edges 74 of the element 46 are bent round toward the groove orifice of the holding groove 58. The bent-round longitudinal edges 74 (cf. FIG. 2) bear, prestressed, against chamfers 76 arranged on the underside of the blade root. Since the intermediate pieces 44 are designed in a similar way to the blade roots 50 of the blades 25, 27, those regions of the longitudinal edges 74 of the element 46 which are established below the intermediate piece 44 also bear, prestressed, against corresponding chamfers. The bent-round longitudinal edges 74 of the element 46 and the prestressed bearing of the elements 46 against the blade roots 50 or intermediate pieces 44 give rise to a nonpositive coupling of the adjacent components, namely the blade root 50 and intermediate piece 44, which improves their orientation and reduces contact wear between the components.

Figure 6:
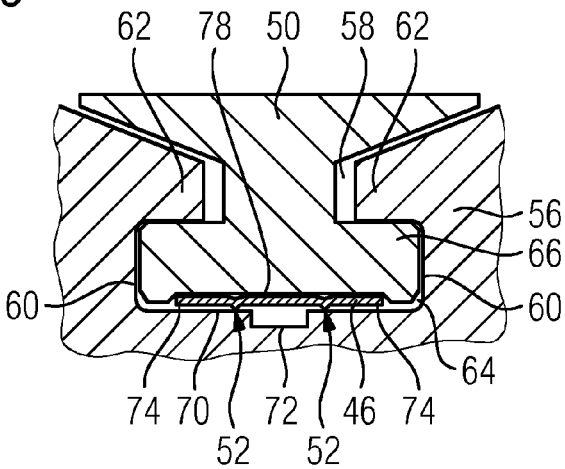

A third refinement of a blade arrangement 40 is illustrated diagrammatically in FIG. 6. FIG. 6, too, shows as far as possible the same cross section as FIG. 3, and therefore features identical in FIG. 6 to FIG. 3 are given the same reference symbols. In contrast to the refinement according to FIG. 3, the third refinement according to FIG. 6 has on the blade root underside 68 a comparatively wide groove 78 which, however, is provided with low depth, and which extends in the longitudinal direction of the holding groove 58. The groove 78 serves for receiving the element 46, and therefore the groove depth of the groove 78 corresponds essentially to the wall thickness S of the element 46. The longitudinal edges 74 of the element 46 (cf. FIG. 2) bear against the inclined side walls of the groove 78. To the same extent as in the case of the blade root 50, according to the third refinement, in the case of the intermediate pieces 44, a groove 78 arranged on their underside is also provided, so that the longitudinal edges 74 of the element 46 also bear against the side walls of the groove 78 arranged on the intermediate piece 44.

By the elements 46 bearing simultaneously against the blade 25, 27 and the intermediate piece 44, coupling of the adjacent blade ring components is brought about, thus reducing wear, in particular contact wear. Both in the second refinement according to FIG. 5 and in the third refinement according to FIG. 6 of the blade arrangement 40 according to the invention, the blades are designed as moving blades 27.

Figure 7:
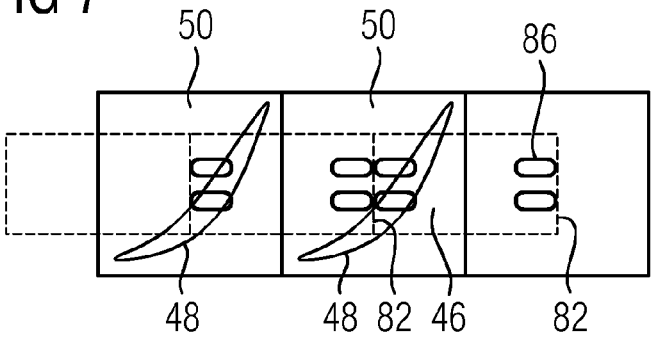
FIG. 7 shows a top view of a portion of a blade arrangement according to a fourth refinement (without intermediate pieces)
Figure 8:
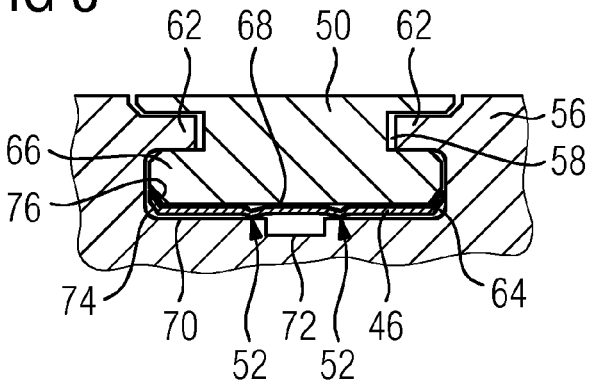
FIG. 8, FIG. 9 show two variants of the fourth refinement according to FIG. 7 in cross section along the sectional line III-III.
Figure 9:
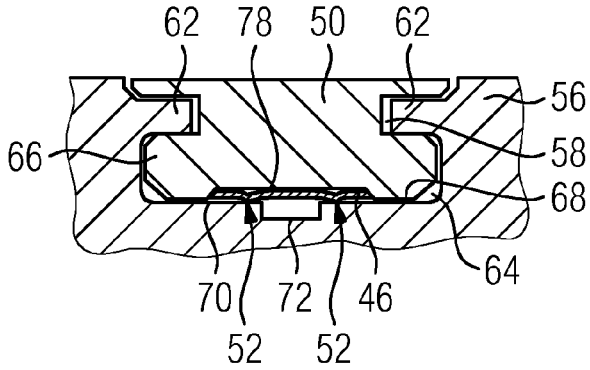

FIGS. 8 and 9 show, in a similar way to the cross section according to FIG. 3, a cross section through a blade arrangement 40 according to a fourth refinement. In contrast to the abovementioned refinements, the arrangements shown in FIGS. 7, 8 and 9 are configured as guide blade rings, not as moving blade rings. The cross-sectional contours of the holding groove 58 and of the blade root 50 differ from one another only slightly as a result. A further difference from the refinements described hitherto is that no intermediate pieces 44 are provided between adjacent guide blades 25. As shown in the illustration according to FIG. 7, therefore, the blades 25 bear one against the other over their area and without any positioning of the blade roots 50. In this case, the elements 46 are arranged in each case by half under a pair of adjacent blades 25. As a result of this, the stiffening beads 52 are also not established in the inner region in the element 46, but instead at two opposite transverse edges 82 of the elements 46. Otherwise, the first variant of the fourth refinement according to FIG. 8 is designed in a similar way to the second refinement according to FIG. 5 with the angled longitudinal edges 74 of the element 46. A second variant of the fourth refinement, shown in FIG. 9, corresponds structurally essentially to the third refinement according to FIG. 6 in which the element 46 is for a large part countersunk into a groove 78 arranged on the blade root underside 68.

Figure 10:
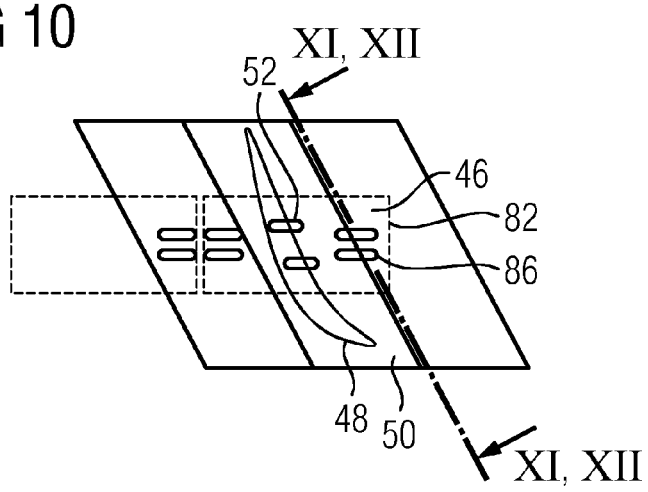
FIG. 10 shows a top view of a portion of a blade arrangement according to a fifth refinement (without intermediate pieces)
Figure 11:
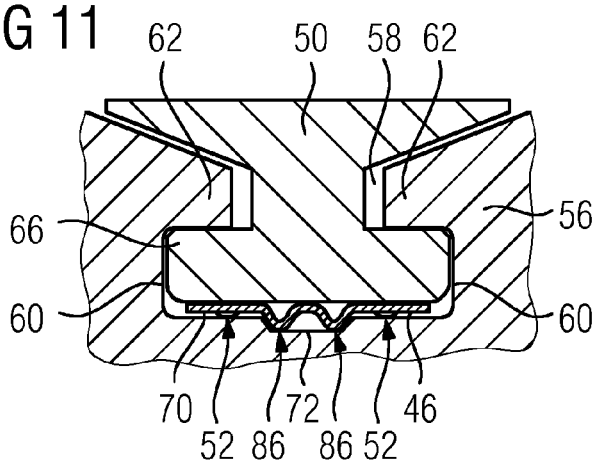
FIG. 11, FIG. 12 show two variants of the fifth refinement according to FIG. 7 in cross section along the sectional line III-III.
Figure 12:
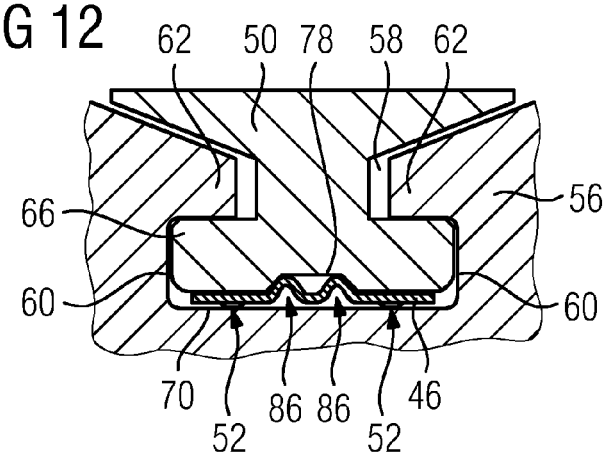

A fifth refinement of the blade arrangement 40 is illustrated in a top view according to FIG. 10, of which two variants are shown, a first in cross section in FIG. 11 and a second in cross section in FIG. 12. The fifth refinement illustrated in FIG. 5 is based essentially on the first refinement illustrated in FIG. 2. However, in addition to the beads 52 arranged in the inner region of the element 46, further beads 86 are provided at the transverse edges 82 in a similar way to the fourth refinement shown in FIG. 7. By the further beads 86 being used at the margin, the element 46 can reliably be prevented from bending out of shape or collapsing when it is being driven in between the blade route underside 68 and groove bottom 70. At the same time, the further beads 86 engage either into the demounting groove 72 (FIG. 11) or into a groove 78 (FIG. 12), arranged on the underside of the blade root, for the alignment or guidance of the elements 46.

Figure 14:
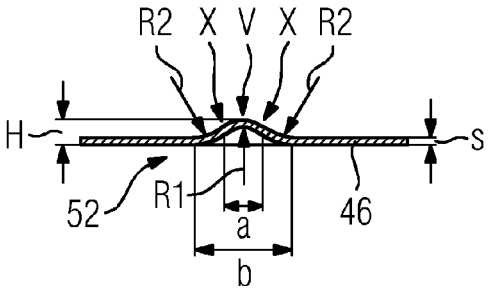
FIG. 14, FIG. 15 show the cross section through an element having different geometries of beads.
Figure 15:
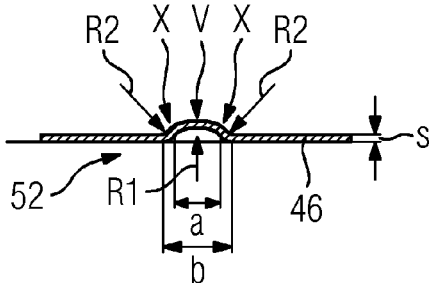

FIGS. 14 and 15 show in each case a refinement of the element 46 in cross section along the sectional line III-III from FIG. 2. In contrast to the element 46 illustrated in FIG. 2, FIGS. 14, 15 illustrate only one bead 52, not two beads 52. Each bead 52 comprises two convexly curved portions X and a concave portion V arranged between them. The convex portions X have in each case a radius R2 and the concave portions V a radius R1. Moreover, the concave portion V has a chord length a, the bead 52 comprising a bead width b. In order to obtain the bead 52 itself with a region of plastic deformation for a higher load force and a higher spring constant and for a region having elastic deformation with a low spring constant, two embodiments of the element are proposed. The first embodiment is achieved when $R1>1.5*S$, $3*R2>R1>0.7*R2$ and $10*b$ to $1.7*b>a$.

For example, the parameters may have the following dimensions:

R1=2 mm; R2=2 mm; S=1 mm; a=3.5 mm and b=10 mm.

The second refinement of an element 46 provides for $R1>5*S$, $3*R2<R1$ and $a<0.9*b$.

For example, the parameters may have the following dimensions:

R1=20 mm; R2=2 mm; S=1 mm; a=6 mm and b=10 mm.

Figure 13:
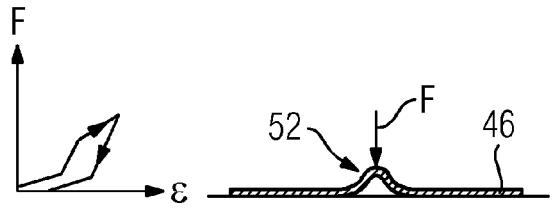
FIG. 13 shows a force/elasticity graph.

With the aid of the refinement shown, it is possible that the portion V represents the region of plastic deformation with a higher load force and higher spring constant and the portions X represent the regions for elastic deformation with a low spring constant, as also illustrated in FIG. 13.

Figure 16:
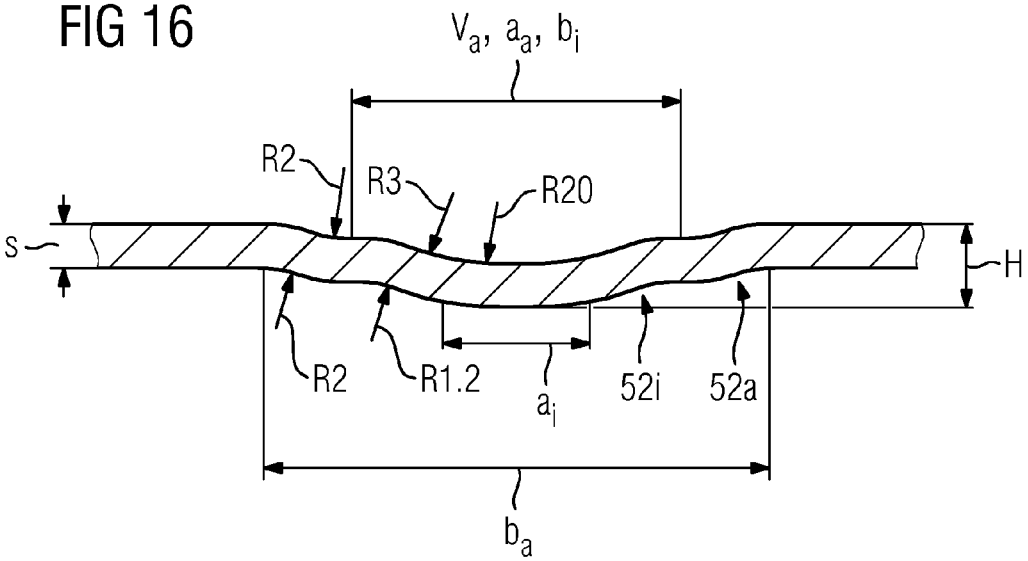
FIG. 16 shows the cross section through a bead geometry in the form of a double bead.

FIG. 16 shows the cross section through a special bead geometry. The special bead geometry is a multiple bead 55 in which an inner bead **55*i* is surrounded by one or more beads 55*a*. The beads 55*i*, 55*a* of the multiple bead 55 are arranged, virtually stacked or hierarchically, with a common center M. The multiple bead 55 shown in FIG. 16 is a twofold bead, also called a double bead. Double beads mean in this case that a basically concave portion Va of a first (then outer) bead 55*a* has established in it a second (then inner) bead 55*i*. This bead combination has further-increased elasticity, as compared with the abovementioned geometries, which may be designated as single beads, with the result that higher manufacturing tolerances can be permitted for the blade roots 50, if appropriate the intermediate pieces 44 and the holding groove 58. Dimensions for the bead geometry according to FIG. 16** are then, for example:

R20=20 mm; R1.2=2 mm; R2=2 mm; ba=11 mm, aa=bi=7.4 mm, R3=2 mm and ai=3.2 mm.

The invention relates overall to a blade arrangement 40 with a blade carrier 56 and with a holding groove 58 which is arranged therein and which has on its side walls 60 longitudinally extending projections 62 for the formation of undercuts 64, and in which a number of blades 25, 27 for forming a blade ring of a turbomachine are inserted, each blade 25, 27 having in addition to an airfoil 48, for fastening, a hammer-shaped blade root 50 engaging into the undercuts 64 and being pressed against the projections 62 by an element 46 arranged between a blade root underside 68 and a groove bottom 70 of the holding groove 58. In order to specify especially secure, reliable, long-lived and low-wear fastening, which makes especially simple mounting and demounting possible, there is provision whereby each element 46 is of plate-shaped design, has, in the projection of the airfoil 48 in the direction of the groove bottom 70, at least one bead 52, arranged below the airfoil 48, for pressing down and is covered in the longitudinal direction of the holding groove 58 only partially by the blade root 50 pressed down by said element.

The invention claimed is:

1. A blade arrangement, comprising:

a blade carrier and a holding groove which is arranged in the blade carrier and which has on its side walls longitudinally extending projections for the formation of undercuts, and in which a number of blades for forming a blade ring of a turbomachine are inserted, each blade having an airfoil and a blade root for engaging into the undercuts and being pressed against the projections by a plate-shaped element arranged between a blade root underside and a groove bottom of the holding groove, said plate-shaped element having at least one bead, wherein each element is covered in a longitudinal direction of the holding groove only partially by the blade root pressed by said element and wherein an intermediate piece is inserted in the holding groove between two blades and is pressed against the projections by a part of the element which is not covered by the blade root.

2. The blade arrangement as claimed in claim 1, wherein the element presses the respective intermediate piece against the projections with lower force than it presses the respective blade root against the projections.

3. The blade arrangement as claimed in claim 2, wherein a part of the element which is covered by the blade root is designed to be partially more rigid than the part of the respective element which is not covered by the blade root.

4. The blade arrangement as claimed in claim 1, wherein a part of the element which is not covered by the respective blade root has at least one orifice for demounting.

5. The blade arrangement as claimed in claim 1, wherein a longitudinally extending groove is arranged in the groove bottom of the holding groove or in the blade root underside.

6. The blade arrangement as claimed in claim 1, wherein the element has, in a projection, an outer contour which is substantially rectangular.

7. The blade arrangement as claimed in claim 6, wherein at least one longitudinal edge of the element is angled and bears, prestressed, against the blade roots shaped correspondingly to it.

8. The blade arrangement as claimed in claim 7, wherein at least one longitudinal edge of the element is angled and bears, prestressed, against the blade root shaped correspondingly to it and against the intermediate piece shaped correspondingly to it.

9. The blade arrangement as claimed in claim 6, wherein at least one further bead is provided at at least one margin of the element.

10. The blade arrangement as claimed in claim 1, wherein the element has a wall thickness (s) and the bead has a cross section comprising a bead width (b) and also two convex portions (X) with a radius (R2) and a concave portion (V), arranged between them, with a radius (R1), with a chord length (a), to which the following applies:

$R1>1.5*s$, $3*R2>R1<0.7*R2$ and $10*b$ to $1.7*b>a$.

11. The blade arrangement as claimed in claim 1, wherein the bead is configured as a multiple bead.

12. The blade arrangement as claimed in claim 11, wherein the multiple bead comprises an inner bead which is established in at least one outer bead at least partially surrounding the inner bead.

13. An axial compressor for a gas turbine, with a moving blade ring and/or a guide blade ring designed as a blade arrangement as claimed in claim 1.

14. The blade arrangement as claimed in claim 1, wherein the element has a wall thickness (s) and the bead has a cross section comprising a bead width (b) and also two convex portions (X) with a radius (R2) and a concave portion (V), arranged between them, with a radius (R1), with a chord length (a), to which the following applies:

$R1>5*s$, $3*R2<R1$ and $a<0.9*b$.

15. The blade arrangement as claimed in claim 1, wherein a thickness of the element is smaller than a gap between the blade root underside and the groove bottom and wherein the bead is configured such that a height of the element at the bead is beyond the gap so that the blade root is pressed against the projections.

16. The blade arrangement as claimed in claim 15, wherein the bead has a cross section comprising a bead width (b) and also two convex portions (X) with a radius (R2) and a concave portion (V), arranged between them, with a radius (R1), with a chord length (a).

17. The blade arrangement as claimed in claim 16, to which at least one of the following applies:

$R1>5*s$, $3*R2<R1$ and $a<0.9*b$.

18. The blade arrangement as claimed in claim 1, wherein the elements are arranged centrally below respective blades.

19. The blade arrangement as claimed in claim 18, wherein two adjacent elements include opposite ends positioned below the intermediate piece positioned between the two adjacent elements.

* * * * *